US006817386B2

(12) United States Patent
Tsukano et al.

(10) Patent No.: US 6,817,386 B2
(45) Date of Patent: Nov. 16, 2004

(54) FILLING VALVE

(75) Inventors: Kenichi Tsukano, Ishikawa-ken (JP); Katsunori Tanikawa, Ishikawa-ken (JP); Taro Kitayama, Ishikawa-ken (JP)

(73) Assignee: Shibuya Kogyo Co., Ltd., Ishikawa-ken (JP)

( * ) Notice: Subject to any disclaimer, the term of this patent is extended or adjusted under 35 U.S.C. 154(b) by 0 days.

(21) Appl. No.: 10/687,278

(22) Filed: Oct. 16, 2003

(65) Prior Publication Data

US 2004/0118479 A1 Jun. 24, 2004

(30) Foreign Application Priority Data

Oct. 17, 2002 (JP) ..... 2002-303481

(51) Int. Cl.[7] ..... B65B 31/00

(52) U.S. Cl. ..... 141/57; 141/54; 141/63; 141/146; 141/192; 141/198

(58) Field of Search ..... 141/39–59, 144–146, 141/192, 198

(56) References Cited

U.S. PATENT DOCUMENTS 4,369,820 A 1/1983 Ahlers et al.
5,377,726 A * 1/1995 Clusserath ..... 141/39
5,501,253 A * 3/1996 Weiss ..... 141/40
5,727,606 A * 3/1998 Weiss ..... 141/40
5,924,462 A * 7/1999 McKaughan ..... 141/145

FOREIGN PATENT DOCUMENTS

JP 56-142189 11/1981
JP 6-144491 5/1994
JP 8-11989 1/1996

* cited by examiner

*Primary Examiner*—Timothy L. Maust
(74) *Attorney, Agent, or Firm*—Flynn, Thiel, Boutell & Tanis, P.C.

(57) ABSTRACT

A liquid passage 4 for filling which communicates with a liquid supply piping 6 for filling is formed within a valve housing 2 and carries a filling nozzle 31 at its lower end. The liquid passage 4 is opened or closed by a liquid valve. A packing 38 which seals the mouth of a vessel B, a cylinder 42 which elevates the packing 38, a flow meter 33 which detects a filled content of the liquid which is filled into the vessel B, and an exhaust passage 44 formed in the valve housing 2 are provided. The exhaust passage 44 has an opening disposed toward the vessel which is disposed outside an opening of the filling nozzle 31, and the opening of the filling nozzle 31 is maintained above the elevation of the liquid level which is filled into the vessel B during the filling operation. The filling valve assures a sanitary excellence and is usable with vessels B of differing sizes and shapes.

15 Claims, 2 Drawing Sheets

FILLING VALVE

BACKGROUND OF THE INVENTION AND RELATED ART STATEMENT

The present invention relates to a filling valve installed on a filler, and in particular, to a filling valve which is used to fill a carbonated beverage or non-carbonated beverage into a vessel while the mouth of the vessel is sealed by a seal member such as a packing.

A filler generally includes a filling valve comprising a liquid passage for filling formed within a valve housing, a filling nozzle mounted on the downstream end of the liquid passage and a liquid valve which functions to open or close the passage through which the liquid passes, the arrangement being such that the filled liquid is injected into the vessel from the filling nozzle mounted on the downstream end of the liquid passage while the liquid valve is open.

When such a filler is used to fill a vessel with a carbonated beverage, for example, there is a need to close a top end opening of the vessel, and accordingly, a cylindrical elevating member is fitted into the valve housing of the filling valve. A centering guide which guides the top end opening of a vessel is mounted on the elevating member together with a packing which seals the top end opening so that the filling operation takes place while the packing is held pressed against the full perimeter of the top end opening of the vessel to maintain the interior of the vessel sealed. In order to perform the filling operation while the interior of the vessel is maintained in a sealed condition, there must be provided an exhaust passage to exhaust a gas in the vessel. Thus the filling operation of the liquid takes place while exhausting the gas from the vessel through the exhaust passage.

Fillers which perform the filling operation while sealing the mouth of the vessel in a manner mention above are categorized into two types. One of the two filling types is referred to as pressure balanced type (disclosed in Japanese Laid-Open Patent Publication No. 11,989/1996, for example), which is constructed as mentioned below. Specifically, a casing is fixedly mounted on the bottom surface of a filler bowl in an upright manner, and a pipe (a valve stem and a vent tube at the lower end of the stem) is passed through the casing in an elevatable manner. The interior of the pipe defines an exhaust passage while the outside of the pipe serves as a liquid passage for filling, which is opened or closed by a liquid valve. During the filling operation, the vent tube located on the lower end of the valve stem is inserted into the vessel and the liquid valve is opened.

When the liquid valve is opened, the liquid flows into the vessel through the liquid passage and the filling nozzle, while any gas contained within the vessel is discharged into a space above the liquid within the filler bowl through the exhaust passage. When the liquid level of the liquid filled into the vessel rises to block the opening of the exhaust passage and a balance is reached between the pressure within the vessel and the pressure within the filler bowl, the filling operation is completed. A spreader is mounted around the outer periphery of the vent tube to cause the liquid flowing into the vessel to flow along the internal surface of the vessel, thus preventing the liquid flow from bubbling.

A filler according to the other filling type includes a flow meter or a level sensor to detect the filled content, and completes a filling operation when the content reaches a given quantity, thus representing a filled content detection type (disclosed in Japanese Laid-Open Patent Application No. 144,491/1994, for example). A filler disclosed in the second citation includes an annular liquid supply path defined between a housing and an internal piece disposed inside the housing and which is opened or closed by a liquid valve, which is an annular closing element moved up and down in response to a cylinder. The annular liquid supply path has a pouring port, which is conically enlarged downwardly, thus allowing a jet of liquid to be led toward the internal wall of the vessel before flowing down toward the bottom.

A gas passage is formed on the top of the internal piece, and is connected through an exhaust valve to an exhaust chamber and is also connected through a suction valve to a gas space of an annular tank. A liquid level sensor is mounted centrally on the internal piece, and the liquid valve is closed when a distance between the level sensor and the liquid level reaches a given value.

In the arrangement disclosed in the first citation, a liquid to be filled remains within the exhaust passage at the time the filling operation is completed, and must be discharged before the next filling operation can be started. In particular, when a high rate operation is desired, there is a need for the provision of a special discharge mechanism. In addition, the liquid to be filled contacts the vent tube during the filling operation, thus leaving a sanitary problem. Furthermore, when the size or the shape of the vessel is changed, the vent tube which defines the exhaust passage or the spreader must be changed, which is a disadvantage.

In the arrangement disclosed in the second citation, the opening of the exhaust passage is located above the opening of the liquid supply path, and accordingly, the exhaust passage cannot be contacted by the liquid to be filled, and there is no residue of the liquid to be filled within the exhaust passage upon completion of the filling operation. However, in this arrangement, the liquid to be filled flows along the internal wall of the vessel while it is filled, and accordingly, when a canister or a vessel having a flat internal surface around the mouth and a smooth shoulder is to be filled, a bubbling can be suppressed since the liquid to be filled flows along the internal surface of the vessel, but a bubbling is induced by a splashing of the liquid to be filled into a vessel such as a reseal can or a bottle can in which the internal surface around the mouth is formed with an unevenness which corresponds to the configuration of a thread formed around the external surface.

OBJECT AND SUMMARY OF THE INVENTION

The present invention has been made in order to overcome the described problems and has for its object the provision of a filling valve which is excellent in sanitary performance and which avoids the need of replacement of an attachment for vessels of differing sizes and shapes. It is also an object of the present invention to provide a filling valve which allows a filling operation to take place through the center of a vessel and which allows a stable filling operation which is not influenced by the shape of the vessel.

Above objects are accomplished by providing a filling valve comprising a valve housing internally formed with a liquid passage for filling which communicates with a liquid supply piping for filling and having a filling nozzle at its lower end, a liquid valve for opening or closing the liquid passage, liquid valve elevating means for elevating the liquid valve, seal means mounted on the valve housing for sealing the mouth of a vessel supplied, seal elevating means for elevating the seal means and vessel relative to each other, filled content detecting means for detecting the quantity of liquid which is filled into the vessel, and an exhaust passage formed in the valve housing for exhausting a gas from within the vessel; wherein the exhaust passage has an opening disposed toward the vessel which is disposed outside of an opening of the filling nozzle and the opening of the filling nozzle is maintained above the elevation of the liquid level which is filled into the vessel during the filling operation.

In the filling valve according to the present invention, an opening of the exhaust passage is located outer circumference of the filling nozzle at the end of the filling nozzle, and since the filling nozzle is located inside to allow the liquid filling to take place centrally in the vessel, a stable filling operation can be achieved without being influenced by the shape of the vessel. The opening of the filling nozzle is disposed at an elevation which cannot be contacted by the liquid level of the liquid which is filled into the vessel, thus providing an excellent sanitary achievement. In addition, there is no need of replacing an attachment for vessels of differing sizes and shapes.

A filling valve according to the invention defined in claim 2 is characterized in that the liquid passage for filling is formed with a greater diameter at a location where it communicates with the liquid supply piping for filling in a manner such that the area of the liquid passage at the location having a greater diameter is greater than the liquid channel area of the liquid supply piping for filling, and a restriction is formed downstream of the location having a greater diameter.

In the filling valve according to the invention defined in claim 2, the provision of a portion of the greater diameter at the inlet to the liquid passage for filling from the liquid supply piping for filling moderates the flow of the liquid, and the restriction which is provided downstream thereof also suppresses the flow, thus allowing the liquid which is filled into the vessel to flow gently to prevent a bubbling from occurring if the liquid is not arranged to flow around the internal wall of the vessel.

A filling valve according to the invention defined in claim 3 is characterized in that a straightening vane which straightens the liquid to be filled is provided in the liquid passage for filling at a location upstream of the liquid valve.

In the filling valve according to claim 3, the straightening vane functions to straighten the flow of the liquid to be filled before it is injected into the vessel, thus allowing a smooth filling operation while preventing a bubbling from occurring.

A filling valve according to the invention defined in claim 4 is characterized in that the channel area of the filling nozzle is tapered so that the diameter decreases gradually toward the lower end. When the channel area within the filling nozzle is tapered so that the diameter decreases toward the liquid outlet, the effect of straightening the flow of the liquid to be filled is further improved.

DETAILED DESCRIPTION OF PREFERRED EMBODIMENT

Figure 1:
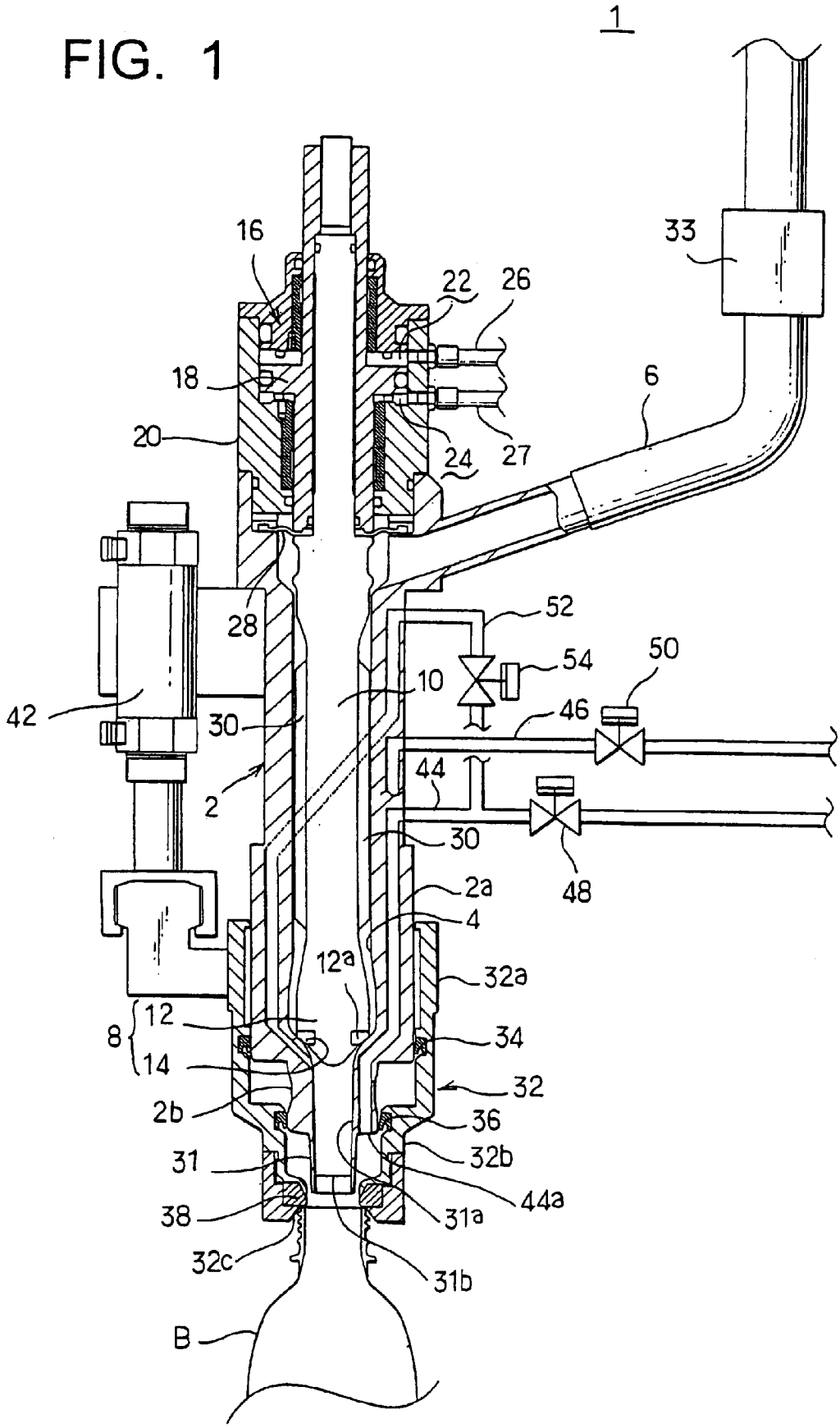
FIG. 1 is a longitudinal section of a filling valve according to one embodiment of the present invention.

The present invention will now be more specifically described with reference to an embodiment thereof shown in the drawings. The filling valve, generally designated by numeral 1, is installed on a filler of a so-called lifterless type which is not provided with a mechanism for elevating a vessel B. The vessel B is conveyed in a horizontal plane to the filling valve 1, and subsequently, a vessel opening packing which will be described later is caused to descend to be pressed against the mouth of the vessel B to seal it, whereupon a filling operation of the vessel B takes place by the filling valve 1.

The filling valve 1 includes a valve housing 2, which is formed with a portion 2*a* of an increased diameter toward its bottom, and is also formed with a portion 2*b* of a reduced diameter which is located below the portion 2*a* of an increased diameter. A liquid to be filled which is fed from a fluid liquid tank, not shown, through a liquid supply piping 6 for filling, is passed through a liquid passage 4 for filling, which is formed within the valve housing 2, to fill the vessel B.

A liquid valve 8 which opens and closes the liquid passage 4 is formed within the valve housing 2. The liquid valve 8 comprises a valve element 12 formed on the lower end of a rod 10 which is passed into the liquid passage 4 in an elevatable manner, and a valve seat 14 formed on the internal surface of the bottom of the liquid passage 4. A seal member 12*a* is fitted around the outer periphery of the portion of the valve element 12 which is adapted to be seated on the valve seat 14 to maintain a liquid tightness. The rod 10 which carries the valve element 12 is moved up and down by a valve opening/closing air cylinder (liquid valve elevating means) 16 which is mounted on a top portion of the valve housing 2.

The construction of the valve opening/closing air cylinder 16 will be briefly described. A piston 18 is disposed on a top portion of the elevating rod 10, and is slidably fitted into a cylinder housing 20 which is secured to the upper end of the valve housing 2, thus partitioning the internal space of the cylinder housing 20 into upper and lower pressure chambers 22, 24. The both pressure chambers 22, 24 are connected to a source of air pressures, not shown, through air passages 26, 27, respectively, thus allowing an air pressure to be introduced into each pressure chamber 22 or 24 or allowing each pressure chamber to be open to the atmosphere. When the air pressure is introduced into the upper pressure chamber 22, the piston 18 moves down together with the elevating rod 10 to cause the valve element 12 to be seated upon the valve seat 14 to close the liquid passage 4. On the other hand, when the air pressure is introduced into the lower pressure chamber 24, the piston 18 moves upward together with the elevating rod 10 to move the valve element 12 away from the valve seat 14 to open the liquid passage 4.

A diaphragm 28 is interposed between the liquid passage 4 which is disposed within the valve housing 2 and the air cylinder 16 which is located above it, thus achieving a perfect isolation between the region of the liquid passage 4 through which a liquid such as a beverage flows and the air cylinder 16 including slidable portions. A plurality of straightening vanes 30 which straighten the flow of the liquid to be filled which passes through the liquid passage 4 are mounted on the external surface of the elevating rod 10 which carries the valve element 12. It is to be noted that the straightening vanes 30 are disposed upstream of the liquid valve 8.

A filling nozzle 31 is disposed within the liquid passage 4 at a location below the liquid valve 8. The filling nozzle 31 has an internal liquid passage 31*a*, which is tapered so that the internal diameter decreases gradually from the upper toward the lower portion, thus enhancing the effect of straightening the flow of the liquid which is to be filled into the vessel B through the filling nozzle 31. A screen 31*b* which prevents any foreign matter which may be mixed into the liquid to be filled from flowing into the vessel B is mounted on the outlet of the internal passage 31*a* of the filling nozzle 31. In this embodiment, the arrangement is such that the filling operation takes place while positioning the distal end of the filling nozzle 31 above the mouth of the vessel B (as shown in FIG. 1), and the liquid outlet of the filling nozzle 31 has an internal diameter which is less than the internal diameter of the mouth of the vessel B.

Figure 2:
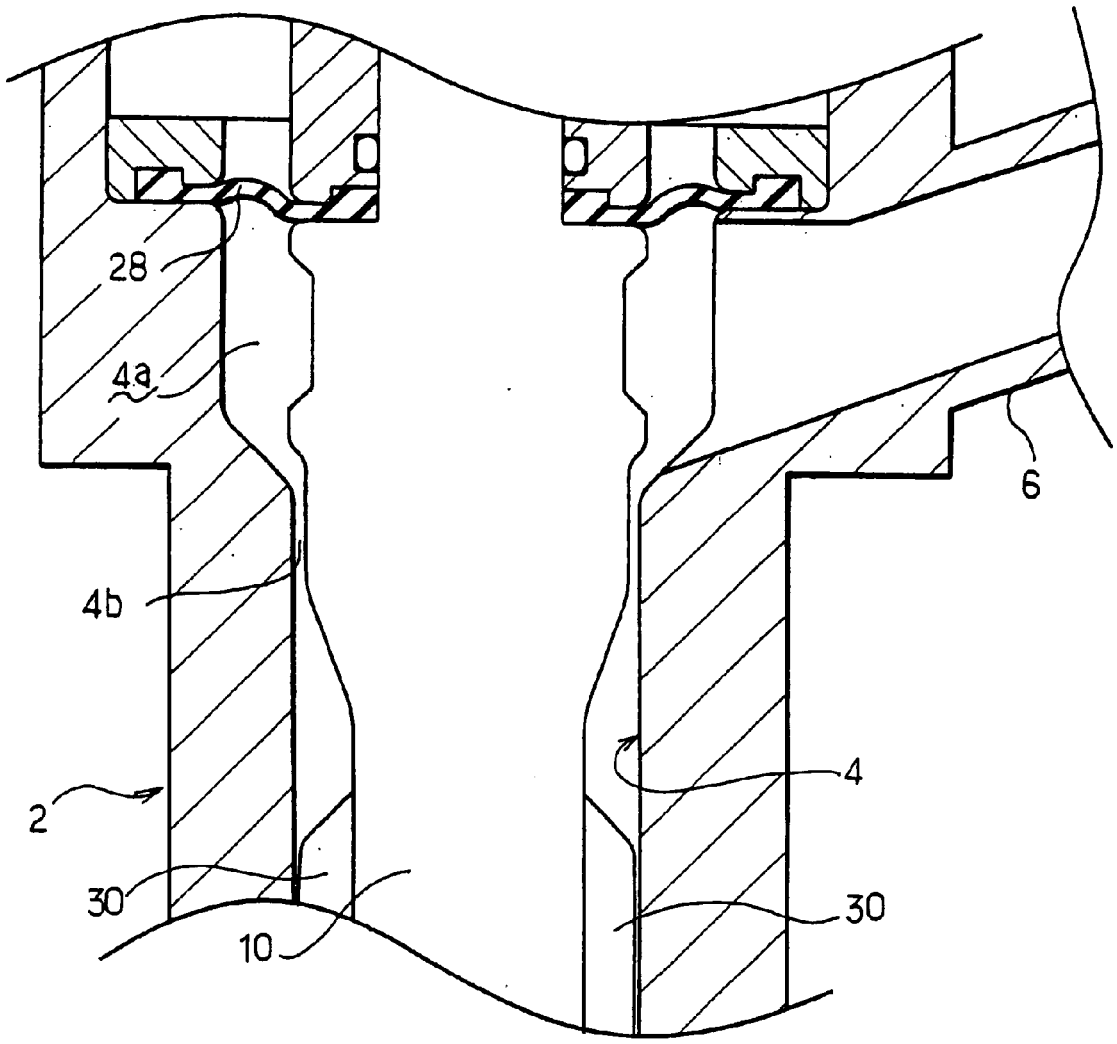
FIG. 2 is a cross section, to an enlarged scale, of an essential part (or a junction between a liquid supply piping for filling and a liquid passage for filling) of the filling valve.

It will be noted that the liquid supply piping 6 is connected toward the top end of the valve housing 2. The construction of a junction between the liquid supply piping 6 and the liquid passage 4 which is disposed within the valve housing 2 will now be described with reference to FIG. 2 which illustrates such portions in an enlarged scale. An upper portion of the liquid passage 4 where the fluid liquid supply piping 6 is connected is formed with a portion 4*a* of a greater diameter, which has a channel area greater than the channel area of the liquid supply piping 6.

A restriction 4*b* is formed below the portion 4*a* of a greater diameter by increasing the external diameter of the rod 10, thus reducing the channel area of the liquid passage 4. When the portion 4*a* of a greater diameter and the restriction 4*b* are formed at the inlet to the liquid passage 4 disposed within the valve housing 2, the liquid to be filled which flows from the liquid supply piping 6 has its flowing speed moderated at the portion 4*a* of the greater diameter and is further throttled by the restriction 4*b*, and thus flows downstream thereafter as a moderated flow. If a pressurized liquid to be filled is supplied from a fluid liquid tank, not shown, it is assured that the portion 4*a* of the greater diameter and the restriction 4*b* which are formed within the liquid passage 4 create a moderated flow as if the liquid to be filled falls down by gravity.

The filler shown includes a flow meter 33 (filled content detecting means) which is disposed within the liquid supply piping 6, whereby the flow rate of the liquid which is fed through the supply piping 6, passed through the liquid passage 4 and filled into the vessel B through the filling nozzle 31 can be detected. However, it is to be noted that the filled content detecting means is not limited to such flow meters 33, but may comprise a non-contact type level sensor which detects the level of the filled liquid from outside the vessel B, for example.

A cylindrical vessel mouth packing unit 32 is fitted around the portion 2*a* of an increased diameter and a portion 2*b* of a reduced diameter which are formed around the external surface of the valve housing 2 toward the bottom thereof. The vessel mouth packing unit 32 comprises a portion 32*a* of an increased diameter which is disposed in a upper portion and a portion 32*b* of a reduced diameter which is disposed in a lower portion. The internal surface of the portion 32*a* of an increased diameter is normally in fitting engagement with the external surface of the portion 2*a* of an increased diameter of the valve housing 2, while the internal surface of the portion 32*b* of a reduced diameter can be in fitting engagement with the external surface of the portion 2*b* of the reduced diameter of the valve housing 2. A first seal member 34 is fitted into the internal surface of the portion 32*a* of the vessel mouth packing unit 32, thus maintaining a hermetic seal with the external surface of the portion 2*a* of an increased diameter of the valve housing 2. A second seal member 36 is fitted into the internal surface of the portion 32*b* of a reduced diameter of the vessel mouth packing unit 32, thus maintaining a hermetic seal between the portions 2*b* and 32*b* when the portion 32*b* of a reduced diameter fits around the portion 2*b* of a reduced diameter of the valve housing 2.

A vessel mouth packing (seal member) 38 having a diameter which substantially matches the opening diameter of the vessel B which is to be filled by the filler including the filling valve 1 is attached to the bottom end of the vessel mouth packing unit 32. The vessel mouth packing unit 32 can be moved up and down by a packing elevating air cylinder (seal elevating means) 42 which is mounted on the valve housing 2, and when the vessel B is to be filled, the packing elevating air cylinder 42 causes the vessel mouth packing unit 32 to descend, thus pressing the vessel mouth packing 38 against the mouth of the vessel B to seal it. At a location below the packing 38, the vessel mouth packing unit 32 has an internal surface 32*c* which is tapered in a manner to increase its diameter in a downward direction, thus serving to guide the mouth of the vessel B which is pressed against the vessel mouth packing 38. It is to be noted that the external diameter of the distal end of the filling nozzle 31 is less than the internal diameter of the vessel mouth packing 38, leaving a clearance therebetween.

A pair of gas passages 44, 46 which open into the lower end face of the portion 2*b* of a reduced diameter are formed within the valve housing 2. One of the gas passages, 44, represents a counter passage (exhaust passage), and is connected through a first opening/closing valve 48 to the head space of a liquid tank for filling, not shown, or a gas space located above a reservoir of filled liquid and the atmosphere in a switchable manner. The other gas passage 46 represents a snift passage, and communicates with the atmosphere through a second opening/closing valve 50. While not shown, the lower portion of the snift passage 46 runs parallel to the exhaust passage 44, and opens into the lower end face of the portion 2*b* of a reduced diameter of the valve housing 2 at a location adjacent to the opening 44*a* of the exhaust passage 44. In the filling valve 1 of the present embodiment, the exhaust passage 44 which extends through the wall of the valve housing 2 is provided to connect with the head space of the liquid tank for filling, thus dispensing with a vent tube which has been provided in a conventional filling valve to eliminate the need to change the attachment when the type of a vessel is changed.

In addition, a third gas passage 52 which is separate from gas passages 44, 46 which open into the lower end face of the portion 2*b* of a reduced diameter is formed within the valve housing 2. The third gas passage 52 represents an air passage which causes the filled liquid to fall down. One end of the third gas passage 52 is connected to a point of the exhaust passage 44 which is located downstream of the opening/closing valve 48 while the other end opens into the filling nozzle 31 at a point in the liquid passage 4 which is located downstream of the liquid valve 8. The air passage 52, which is designed to cause the filled liquid to fall down, can be opened or closed by a third opening/closing valve 54, and upon completion of a filling operation, the opening/closing valve 54 is opened to feed the air into the filling nozzle 31, thus removing any residue of the filled liquid which may remain within the passage 31*a* of the filling nozzle 31.

The operation of the described filling valve 1 will now be described. Initially, a gas charged filling operation which fills a liquid such as carbonated beverage under pressure will be described. In a gas charged filling operation, a filled liquid is contained in a liquid tank for filling, not shown, and a $CO_2$ gas (carbon dioxide gas) is confined under pressure into a space left above the filled liquid.

As mentioned previously, the filler which is contemplated in this embodiment represents a lifterless type where a vessel B is conveyed horizontally to be fed to a location below the filling valve 1 where the filling operation takes place. Specifically, the opening 31*b* of the filling nozzle 31 is not inserted into the vessel B, but the filling operation takes place while maintaining the opening above the mouth of the vessel. At the time the vessel B is fed to a point below the filling valve 1, the vessel mouth packing unit 32 assumes a raised position by the action of the packing elevating air cylinder 42, and after the vessel B has been fed, the vessel mouth packing unit 32 descends. When the vessel mouth packing unit 32 descends, the vessel mouth packing 38 which is contained in the lower portion thereof is pressed against the mouth of the vessel B to seal the interior of the vessel B.

When the filling operation is initiated, the exhaust passage 44 communicates with a gas space in the liquid tank for filling, not shown (a space located above the filled liquid), and after the vessel B has been sealed by the vessel mouth packing 38 in the manner mentioned above, the opening/closing valves 48 and 50 associated with the exhaust passage 44 and the snift passage 46 are opened. Pressurized carbonated gas contained in the liquid tank for filling is introduced into the vessel B through the exhaust passage 44 while the air in the vessel B is discharged through the snift passage 46. After a given time interval, the opening/closing valve 50 associated with the snift passage 46 is closed, and the discharge of the carbonated gas is terminated. Subsequently, the air cylinder 16 which functions to open or close the liquid valve is operated to cause the elevating rod 10 and its integral valve element 12 to move upward, thus removing the valve element 12 from the valve seat 14 to open the liquid valve 8 to allow the filling operation to be initiated.

The liquid to be filled which is supplied from the liquid tank for filling through the liquid supply piping 6 passes through the liquid passage 4 within the valve housing 2 and through the filling nozzle 31 to fill the vessel B, while the carbonated gas in the vessel B is discharged through the exhaust passage 44 to be returned to the gas space within the liquid tank for filling. When the liquid which fills the vessel B flows into the liquid passage 4 from the liquid supply piping 6, the channel area increases at the portion 4*a* of a greater diameter to moderate the flow and subsequently the flow is suppressed by the restriction 4*b* located below the portion 4*a* of a greater diameter. Accordingly, if the filling operation takes place under pressure, the liquid gently flows into the vessel B without any likelihood of bubbling. Since the straightening vanes 30 are disposed within the liquid passage 4 and the liquid passage 31*a* of the filling nozzle 31 is tapered downwardly, the liquid to be filled is further straightened to enter the vessel as a gentle flow.

The flow meter 33 is disposed in the liquid supply piping 6 which supplies the liquid to be filled to the filling valve 1, and when it is detected that a given quantity of liquid has been filled, the air cylinder 16 is operated to close the liquid valve 8, thus terminating the filling operation. In this embodiment, the filling operation takes place without inserting the filling nozzle 31 into the vessel B, but the opening 31*b* of the filling nozzle 31 is maintained above the elevation of the liquid which is filled into the vessel B until the completion of the filling operation. The opening/closing valve 48 of the exhaust passage 44 is closed while the opening/closing valve 54 for the air passage 52 is opened to supply the air into the filling nozzle 31, preventing any liquid to be filled from remaining within the filling nozzle 31.

Upon completion of the filling operation, the opening/closing valve 50 of the snift passage 46 is opened to release the pressurized gas from within the head space of the vessel B to assume an equal pressure as the atmospheric pressure in order to prevent a rapid bubbling of the filled liquid from occurring when the vessel mouth packing 38 is subsequently removed from the vessel B. Subsequently, the air cylinder 42 is operated to cause the vessel mouth packing unit 32 to move upward, thus removing the first packing 38 from the vessel B and delivering the vessel B from the filler.

The filling valve 1 mentioned above is not limited in its use to a gas charged filling operation, but is also applicable to a non-gas filling operation. In this instance, the exhaust passage 44 is maintained open to the atmosphere. The opening/closing valve 50 of the snift passage 46 is closed while the opening/closing valve 48 of the exhaust passage 44 is opened. When the vessel B is fed under this condition, the vessel mouth packing unit 32 is caused to descend by the action of the elevating air cylinder 42, and after the vessel mouth packing 38 is pressed against the mouth of the vessel B, the liquid valve 48 is opened to initiate the filling operation. Upon completion of the filling operation, the opening/closing valves 48 of the exhaust passage 44 is closed in the similar manner as during the filling operation of a gas charged beverage, and the opening/closing valve 54 of the air passage 52 which causes the filled liquid to fall down is opened, thus supplying the air into the filling nozzle 31 to prevent any residue of the filled liquid from remaining within the filling nozzle 31. It is to be noted that for the non-gas filling operation, it is not always necessary that the mouth of the vessel B be sealed by the vessel mouth packing 38.

With the filling valve 1 constructed in the manner mentioned above, the filling operation can take place without any influence by the size or the shape of the vessel B. In addition, there is no need to change the vent tube if the vessel B has a mouth of an equal size. Accordingly, the filling valve can be used with a variety of vessels such as bottles, PET vessels and reseal canisters and the like. In addition, because a filler of a lifterless type which does not require a vessel elevating mechanism can be used, the construction of the filler can be simplified. In addition, because the opening 44*a* of the exhaust passage 44 is disposed outside the filling nozzle 31, and is located above the opening at the distal end of the nozzle, there is no likelihood of being contacted by the liquid to be filled, providing a sanitary excellence. Since the exhaust passage 44 is maintained dry, there is no likelihood that a mist may be blown into when injecting the pressurized gas, thus providing an advantage that a foaming can be avoided.

It is to be understood that the filling valve 1 mentioned above is not limited in its use to a filler of a lifterless type, but is also applicable to a filler of lifter type in which a vessel B is elevated up and down. In this instance, the bottle mouth packing need not be elevatable, but may be fixed. For a filler of lifter type, it is possible to insert the filling nozzle into the vessel, but it is necessary that the lower end of the filling nozzle be maintained above the elevation of the content of the vessel, in order to avoid a contact with the level of the filled liquid.

What is claimed is:

1. A filling valve comprising a valve housing internally formed with a liquid passage for filling which communicates with a liquid supply piping for filling and having a filling nozzle at a lower end, a liquid valve for opening or closing the liquid passage, liquid valve elevating means for elevating the liquid valve, seal means mounted on the valve housing for sealing the mouth of a vessel supplied, seal elevating means for elevating the seal means and vessel relative to each other, content detecting means for detecting the quantity of liquid which is filled into the vessel, and an exhaust passage formed in the valve housing for exhausting a gas from within the vessel during a filling operation;

wherein the exhaust passage has an opening disposed toward the vessel which is disposed outside of an opening of the filling nozzle and the opening of the filling nozzle is maintained above the elevation of the liquid level which is filled into the vessel during the filling operation.

2. The filling valve according to claim 1, wherein the liquid passage for filling is formed with a portion of a greater diameter at a location where the liquid passage communicates with the liquid supply piping for filling, the portion of a greater diameter having a liquid channel area which is greater than the liquid channel area of the liquid supply piping, the liquid passage being formed with a restriction at a location downstream of the portion of a greater diameter.

3. The filling valve according to claim 1, further comprising a straightening vane disposed in the liquid passage at a point upstream of the liquid valve for straightening a flow of the liquid to be filled.

4. The filling valve according to claim 1, wherein the filling nozzle has a nozzle liquid passage which is tapered in the downward direction.

5. A filling valve for filling a vessel comprising:

a valve housing internally formed with a liquid passage for filling, the valve housing including a filling nozzle with an opening at a lower end;

an exhaust passage formed within the valve housing for exhausting a gas from the vessel during a filling operation;

a separate liquid supply piping that opens into the liquid passage of the valve housing;

a liquid valve for opening or closing the liquid passage;

a liquid valve controller for controlling the liquid valve;

a seal device mounted onto the valve housing for sealing the mouth of a vessel to be filled;

a seal device controller for vertically moving the seal device and a vessel relative to each other; and a content device for determining the amount of liquid filled into a vessel, wherein the exhaust passage of the valve housing exhausts gas from within a vessel during a filling operation, and wherein the opening of the exhaust passage is maintained above the elevation of the vessel during a filling operation.

6. The filling valve according to claim 5, wherein the content device for determining the amount of liquid filled into a vessel comprises a content detector that detects the liquid at the separate liquid supply piping.

7. The filling valve according to claim 5, wherein the liquid valve for opening or closing the liquid passage is free from passages or a vent tube extending therethrough.

8. The filling valve according to claim 5, wherein the liquid valve comprises a solid rod axially movable along a longitudinal axis of the valve housing for opening or closing the liquid passage.

9. The filling valve according to claim 5, wherein the filling nozzle comprises a single opening that is shaped to enable liquid to flow into a center of a vessel, and wherein the opening of the exhaust passage is disposed outside of the opening of the filling nozzle.

10. The filling valve according to claim 5, further comprising a snift passage formed in the valve housing and a snift valve for communicating the snift passage with the atmosphere.

11. The filling valve according to claim 10, wherein the snift passage is parallel to the exhaust passage and opens into the valve housing at a location adjacent to the opening of the exhaust passage, and wherein the opening of the snift passage is disposed outside of the opening of the filling nozzle.

12. A filling valve for filling a vessel comprising:

a valve housing internally formed with a liquid passage for filling, the valve housing including a filling nozzle with an opening at a lower end;

a first passage formed in the valve housing and having an opening that is disposed outside of the opening of the filling nozzle;

a second separate passage formed in the valve housing and having an opening that separately opens into the liquid passage of said valve housing;

a separate liquid supply piping that opens into the liquid passage of the valve housing;

a liquid valve for opening or closing the liquid passage;

a liquid valve controller for controlling the liquid valve;

a seal device mounted onto the valve housing for sealing the mouth of a vessel to be filled;

a seal device controller for vertically moving the seal device and a vessel relative to each other; and a content determining device for determining the amount of liquid filled into a vessel.

13. The filling valve according to claim 12, wherein the first passage comprises an exhaust passage for connecting to a headspace of a liquid tank for filling.

14. The filling valve according to claim 13, wherein the opening of said exhaust passage is maintained above the elevation of the liquid in a vessel during a filling operation.

15. The filling valve according to claim 12, wherein the first passage comprises an exhaust passage and the second passage comprises a snift passage, and wherein the openings of said exhaust passage and said snift passage are maintained above the elevation of the liquid in a vessel during a filling operation.

* * * * *